US005618122A

United States Patent [19]

Constantine

[11] Patent Number: 5,618,122

[45] Date of Patent: Apr. 8, 1997

[54] MOLDED PLASTIC ONE-PIECE LOOSE-LEAF BINDER RING STRUCTURE

[75] Inventor: Arthur T. Constantine, Niantic, Conn.

[73] Assignee: C-Lock, Inc., Stamford, Conn.

[21] Appl. No.: 397,906

[22] Filed: Mar. 3, 1995

Related U.S. Application Data

[63] Continuation-in-part of Ser. No. 4,421, Feb. 4, 1993, Pat. No. Des. 356,112.

[51] Int. Cl.[6] ..... B42F 3/02

[52] U.S. Cl. ..... 402/22; 402/31

[58] Field of Search ..... 402/26, 36, 39, 402/19, 29, 22, 31; 281/27.1, 48, 50, 75

[56] References Cited

U.S. PATENT DOCUMENTS

| | | | |
|---|---|---|---|
| 2,363,848 | 11/1944 | Emmer | 402/31 |
| 2,399,561 | 4/1946 | Murphy | 402/20 |
| 3,315,682 | 4/1967 | Bachman | 402/21 |
| 4,577,985 | 3/1986 | Beyer | 402/22 |
| 5,160,209 | 11/1992 | Schuessler | 402/75 |

*Primary Examiner*—Willmon Fridie, Jr.
*Attorney, Agent, or Firm*—Lackenbach Siegel Marzullo & Aronson

[57] ABSTRACT

A molded plastic one-piece loose-leaf ring binder for use in binding loose perforated sheets, book pages and the like. A plastic elongated base strip is ridgidified by ribs extending longitudinally thereof, and has paired integral flexible lugs spaced longitudinally on opposite longitudinal sides of the base strip and extending laterally therefrom. The individual lugs each have an integral arm curved along a length of the arm extending laterally away from the corresponding lug and side of the base strip and each curves in a direction back toward the strip. The curved arms have a cross-section thickness greater than the thickness of the corresponding lug so that their curvature is maintained. The curved arms are paired on opposite sides of the strip and are sufficiently rigid as ring-forming elements insertable into holes of perforated sheets and free ends thereof of a pair locked together to define binder rings. The flexible paired lugs each form a hinge for corresponding paired curved arms on opposite sides of the strip to be manually biased toward each other and free-end portions thereof positioned in overlying relationship for manual pressing of the overlying free-end portions together to close an integral snap lock formed thereon. The snap lock formed by a rigid radial projection on an end portion of a curved arm of a pair is received in a hole on a tongue on a free-end portion of the other curved arm of the corresponding pair and is opened by pressing the curved arm with the projection thereon away from the tongue of the arm in which the projection is received.

10 Claims, 5 Drawing Sheets

MOLDED PLASTIC ONE-PIECE LOOSE-LEAF BINDER RING STRUCTURE

BACKGROUND OF THE INVENTION

This is a continuation-in-part patent application of my copending design patent application Ser. No. 29/004,421 filed Feb. 4, 1993 now U.S. Pat. No. D356,112.

This invention relates generally to ring binders and more particularly to a one-piece loose-leaf binder ring structure made of molded plastic for use in loose-leaf binders, books and notebooks.

A common form of notebook paper is provided with ring apertures. The perforated sheets of paper may have two or three apertures for binding in ring structures with the necessary number of rings for binding the perforated sheets in a book, a notebook or a binder. The paper sheets are generally bought as loose-leaf sheets separately from the notebooks or binders in which they are to be bound.

The binder rings used for binding loose-leaf sheets are generally of the split-ring type. The rings may be separate rings or consist of a plurality of split rings automatically opened and closed jointly and mounted in a structure that is generally provided with a mechanism for opening and closing the binder rings jointly.

The known binder ring structures are generally made of metal and require extensive, and therefore expensive, fabrication. A form of split ring made of a resilient material is disclosed in U.S. Pat. No. 2,251,343. A plastic loose-leaf binder of the split-ring type is disclosed in U.S. Pat. No. 2,363,848 granted to C. E. Summer on Nov. 28, 1944. This patent discloses a binder strip made of a thermoplastic material with integral ring portions having free ends in abutting cooperation. The ring portions are flexed by flexing the strip itself with which they are integral, when being open or closed. The patented strip must be specially treated with a plastic treatment separately from the ring plastic material to provide the required flexure for the rings to be opened and closed. The patent discloses several plastic materials for making the strip and rings and the use of a plasticizer to make flexible the strip. The plastic binder accordingly is not made as a single plastic material structure.

SUMMARY OF THE INVENTION

The loose-leaf binder in accordance with the present invention is made of a same plastic material throughout in a one-piece construction and the operational movements of the elements and flexibility is determined dimensionally without need of special plastic treatments. The plastic used is flexible.

It is an object of the invention to provide a plastic loose-leaf binder ring structure made by injection molding and in which flexibility and rigidity required of the elements is provided by the plastic and and thickness dimensioning and use of rigidifying structure.

Another object is to provide a plastic loose-leaf binder ring structure that has ring-forming elements provided with a snap lock for manually locking the ring closed and easily opened manually.

BRIEF DESCRIPTION OF THE DRAWINGS

The molded plastic one-piece loose-leaf binder ring structure, according to the invention, can be understood from the following drawing figures and appended claims in which:

DESCRIPTION OF THE PREFERRED EMBODIMENTS

Figure 1:
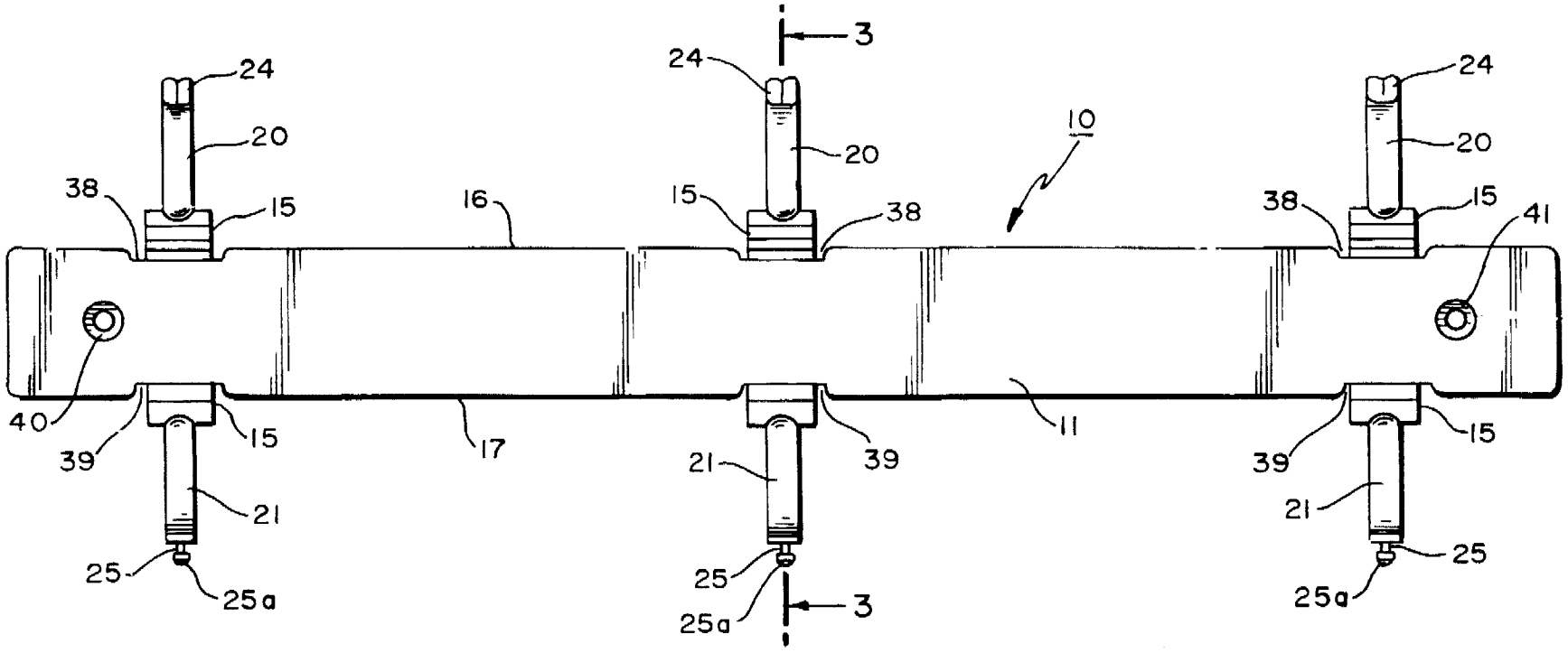
FIG. 1 is a plan top view of a one-piece loose-leaf binder ring structure according to the invention.

The molded plastic one-piece loose-leaf binder ring structure, according to the invention and illustrated in the drawings, is an integral unitary structure 10 having an elongated base strip 11. The base strip 11 is made of a flexible plastic which is rigified by ribs 12, shown in FIG. 2, on an underside thereof. A plurality of flexible lugs 15 are disposed spaced longitudinally of the base strip on opposite sides 16, 17 of the base strip 11. In the illustrated embodiment, three pairs of binder rings comprising six flexible lugs 15 are shown with the lugs 15 directly aligned and paired on opposite sides of the base strip.

Figure 2:
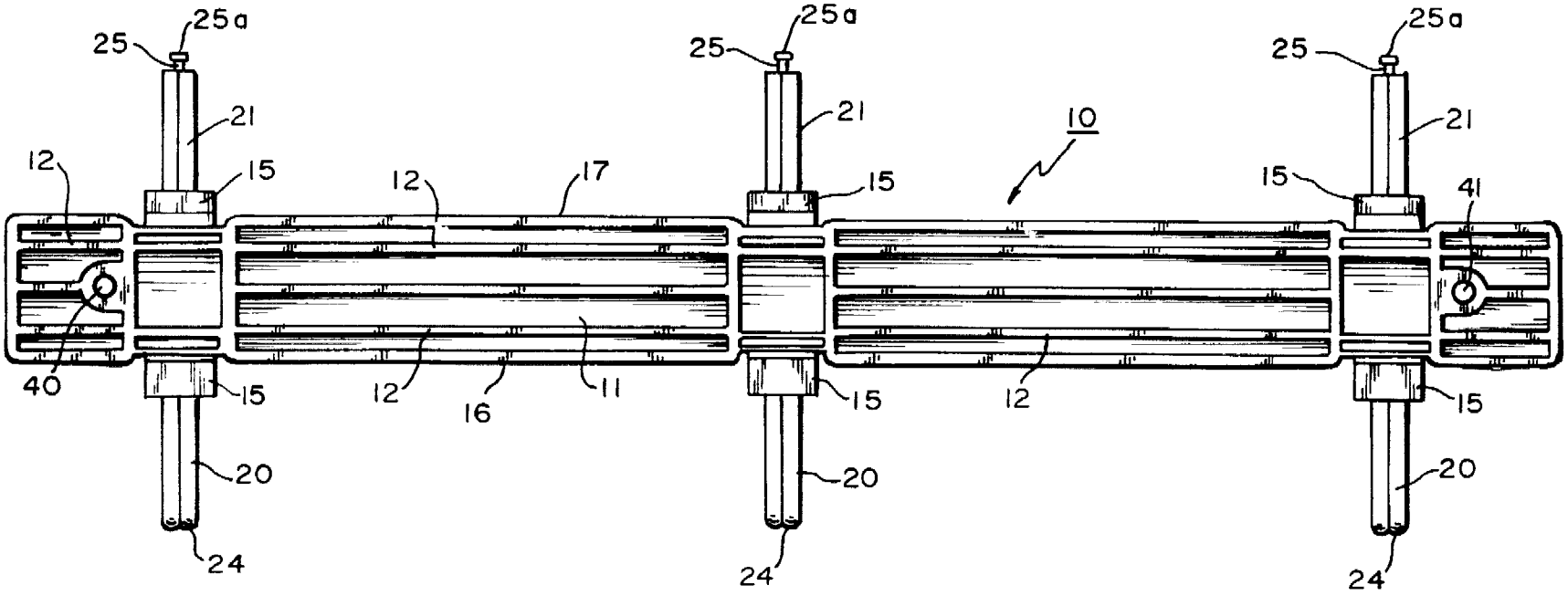
FIG. 2 is an underside view of the binder ring structure shown in FIG. 1.
Figure 3:
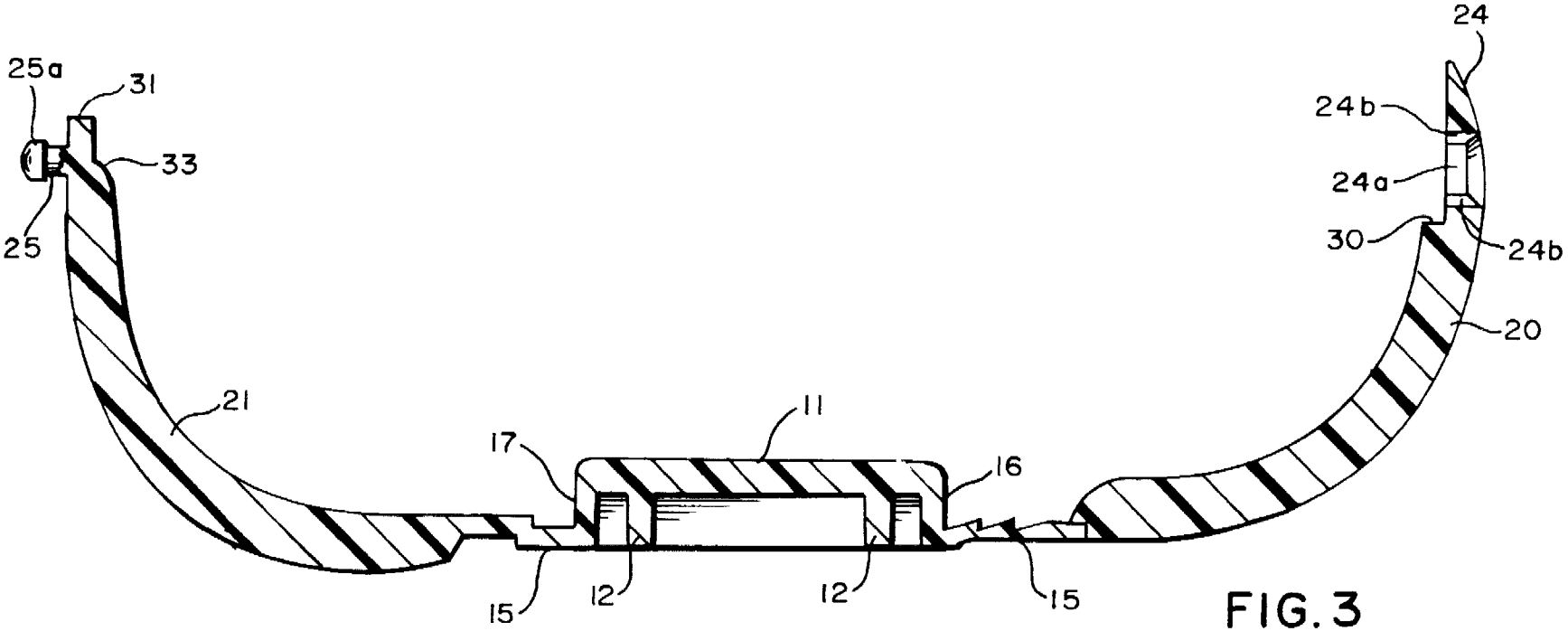
FIG. 3 is a cross-section view taken along section line 3—3 of FIG. 1.

The flexible lugs 15 extend outwardly laterally of the base strip side lower edges as shown in FIGS. 1–3. The lugs 15 are molded integrally with the base strip and are of a thickness dimension selected so that they are flexible for flexure relative to the base strip 11. The individual flexible lugs each have an integral curved arm 20, 21 extending laterally therefrom. The individual curved arms have a cross-section thickness dimension greater than the thickness of the corresponding lug with which it is integral. Each curved arm 20, 21 has a curvature along a length thereof extending laterally of the base strip, and the curvature is such that the curved arms 20, 21 extend in a direction away from the base strip and curve back toward the base strip 11. The thickness and rigidity of each of the curved arms is selected so that the individual arms retain their respective curvature.

The curved arms 20, 21 are paired similarly to the respective flexible lugs. Each pair of curved arms is disposed directly aligned on opposite longitudinal sides 16, 17 of the base strip 11. The curved arms are the ring-forming elements of the binder ring structure 10.

The individual flexible lugs 15 form a hinge or a pivot for the corresponding integral curved arms 20, 21 thereon. The curved arms of each respective pair of the paired curved arms 20, 21 can thus be manually biased or pivoted in a direction toward each other so that the distal or free-end portions thereof are positioned in an overlying relationship and coupled for jointly defining a corresponding binder ring.

Figures 5, 6, 7, 8:
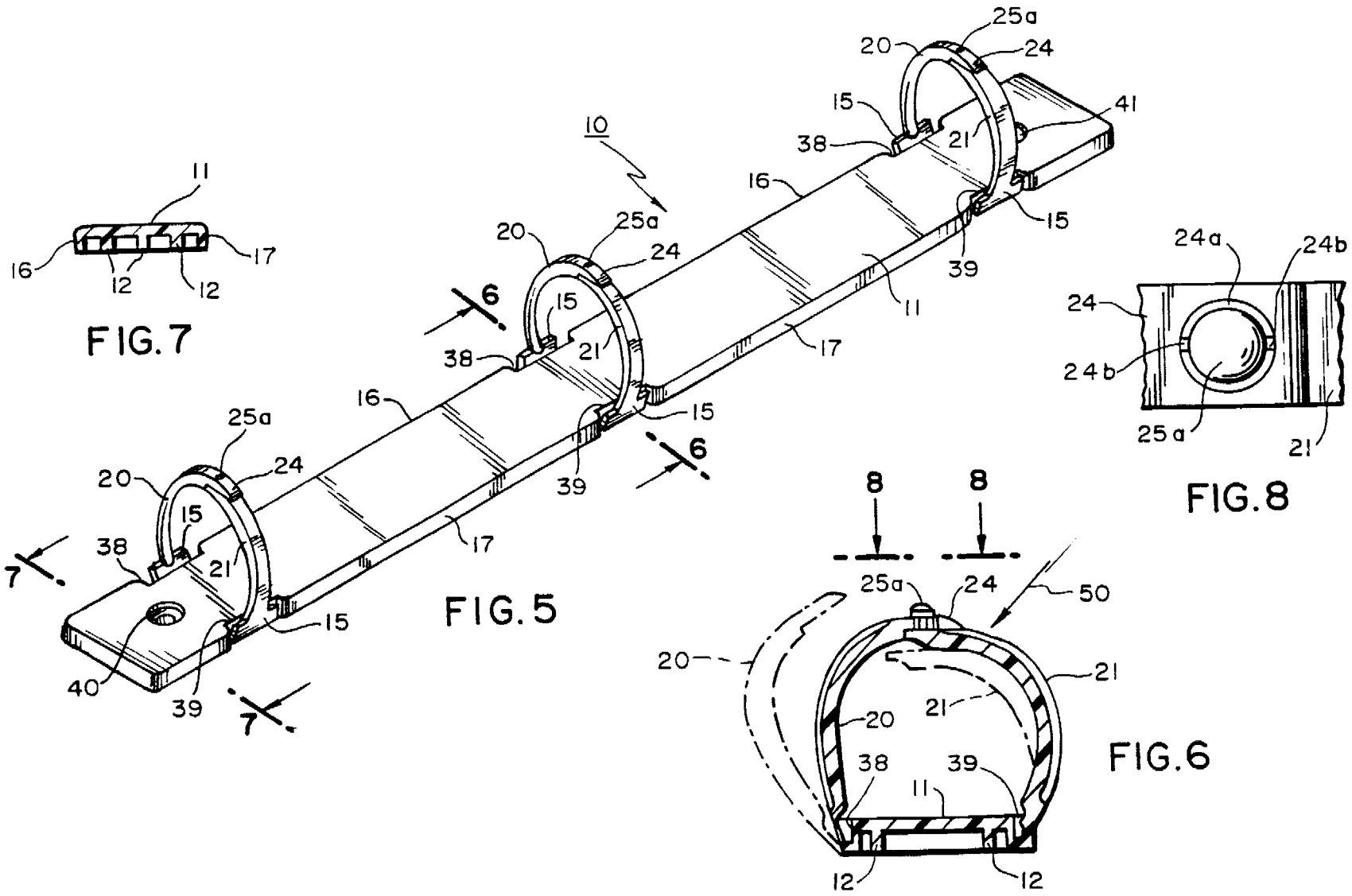
FIG. 5 is a perspective view of the binder ring structure shown in FIG. 1; but with the current arms in a closed and locked position.
FIG. 6 is a cross-section view taken on section line 6—6 of FIG. 5.
FIG. 7 is a cross-section view taken on section line 7—7 of FIG. 5.
FIG. 8 is a fragmentary plan view taken from line 8—8 of FIG. 6.

The lugs on one longitudinal side 16 of the base strip are shaped and dimensioned laterally similarly and those on an opposite longitudinal side 17 have a common shape and dimension laterally the same but are shaped and dimensioned differently from the opposite longitudinal side 16. Similarly the curved arms disposed on a same longitudinal side 16 of the base strip have a similar curvature and the curved arms on the opposite longitudinal side 17 of the base strip have a common curvature that is different from the curvature of the other longitudinal side 16 of the base strip 11 in order to form substantially circular rings as shown in FIG. 6 when coupled. The planar configuration and planar dimensions of the flexible lugs 15 are correlated to the length and curvature of the respective curved arms so that the curved arms of a corresponding pair 20, 21 can have their respective free-end portions properly disposed in overlying registered relationship for forming a corresponding binder ring and so that the curved arms can be readily coupled to define a binder ring and then uncoupled easily.

Figure 4:
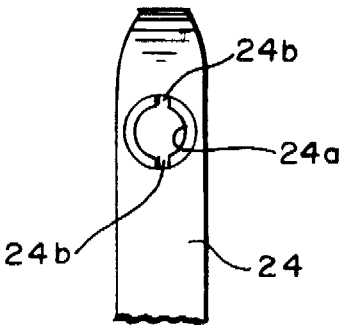
FIG. 4 is a fragmentary view of a tongue of a ring-framing element of the binder ring structure shown in FIG. 3.

The ring-forming curved arms 20, 21 of each pair are couplable together and in coupled relationship locked by a snap lock formed on the free-end portions of a corresponding pair of the curved arms as herein described. The curved arms 20 on one side of the base strip each have a flexible tongue 24 with a round hole 24*a* on a free-end portion thereof. The curved arms 21 on the opposite side 17 each have a rigid projection 25 on the free-end portion thereof. The projections 25 extend radially of the corresponding curved arm 21 and have a constriction so that a round or button head 25*a* is formed thereon and received in the hole 24*a* of the related curved arm tongue 24 for jointly forming a snap lock coupling the pair of arms 20, 21 as extensions of each other defining a binder ring. The individual round holes 24*a* in the tongues 24 of the corresponding curved arms 20 have small oppositely disposed radial slots 24*b*, as shown in FIG. 4, so that the button head is more easily received in a corresponding hole which can thus spread. The tongues 24 on the corresponding curved arm 20 are extensions of the arms so that a shoulder 30 is formed on the corresponding arm 20 against which the free-end tips 31 of the curved arms 21, with rigid projections, abut endwise and bear against the shoulder 30 to properly align the free-end portions of the paired curved arms for aligning the button head projections 25 with the respective round holes 24 in which they are received when the curved arms free-end portions are disposed in overlying relationship for coupling the paired arms in a binder ring configuration. Furthermore, the free-end portions of the curved arms 21 with the button head projections have a smooth curve notch 33 formed thereon so that the paired arms when coupled define a relatively smooth connection at the snap lock arrangement for ease of turning the perforated sheets of paper from one side of the binder rings to another when required, for example, in a notebook or a binder.

The base strip 11 is provided with side recess 38, 39 spaced longitudinally of the base strip and disposed paired on opposite sides 16, 17 of the base strip. In the embodiment shown in the drawings, three pairs of recesses 38, 39 in registry with the paired flexible lugs are provided. The recesses 38, 39 have an equal depth and length so that the corresponding individual flexible lugs 15 can be flexed toward the base plate 11. The respective flexible lugs 15 in registry with the recesses 38, 39 can be flexed or pivoted toward the corresponding sides of the base strip such that the free-end portions of the individual ring-forming curved arms 20, 21 thereon are properly positioned in a circumferential direction and relative to the base plate 11 for being coupled, as heretofore described, to form or define respective binder rings.

The base strip 11 is provided with a plurality of openings such as 40, 41 adjacent to the ends thereof for mounting the loose-leaf binder ring structure, for example, in a binder or notebook with fasteners inserted in the openings 40, 41.

The loose-leaf binder ring structure 10 is made of a flexible plastic. High density polyethelene post consumer (HDPE) plastic has been found to be a suitable plastic. The plastic can be virgin plastic, but it has been found that post consumer plastic is better. Plastic obtained from used detergent bottles has been found to work suitably.

The flexibility of the plastic provides for flexure of the lugs 15 which are shown in the cross section in FIG. 3. Moreover, the flexible lugs 15 allow the coupling of the paired arms by manual placing of the free end portions thereof in overlying relationship as shown in FIG. 6. The free-end portions are manually pressed together from on top and underneath the free-end portions for inserting the projection 25 into a corresponding hole 24. The pressure for coupling is applied by the fingers of the user when the paper sheets in the binder permit. If the open binder rings are relatively full, the curved arm 20 free-end portion is pressed downwardly so that the corresponding flexible tongue 24 with round hole 24*a* receives the rigid projection 25, and coupling of the curved arms is effected. It will be noted that each hole 24*a* has a bevel to facilitate entry and housing of a corresponding button head 25*a* therein.

In order to open the closed binder rings, the arm 21 underlying arm 20 need only be depressed by application of pressure at the point shown by the arrow 50 in FIG. 6. The coupled binder rings are thus uncoupled and loose-leaf sheets can be added or removed.

Those skilled in the art will understand that the binder ring structure can be made with three binder rings thereon for use for binding sheets having three perforations, as described, or two binder rings for binding sheets with two perforations. The binder rings can be shaped as substantially round rings or D rings. The binder rings can be of different desired dimensions or sizes to accommodate or hold different numbers of sheets. Moreover, those skilled in the art will understand the molded structure can be mass produced by injection molding in a split mold using a suitable plastic material which is thermoplastic and flexible when set.

Figure 9:
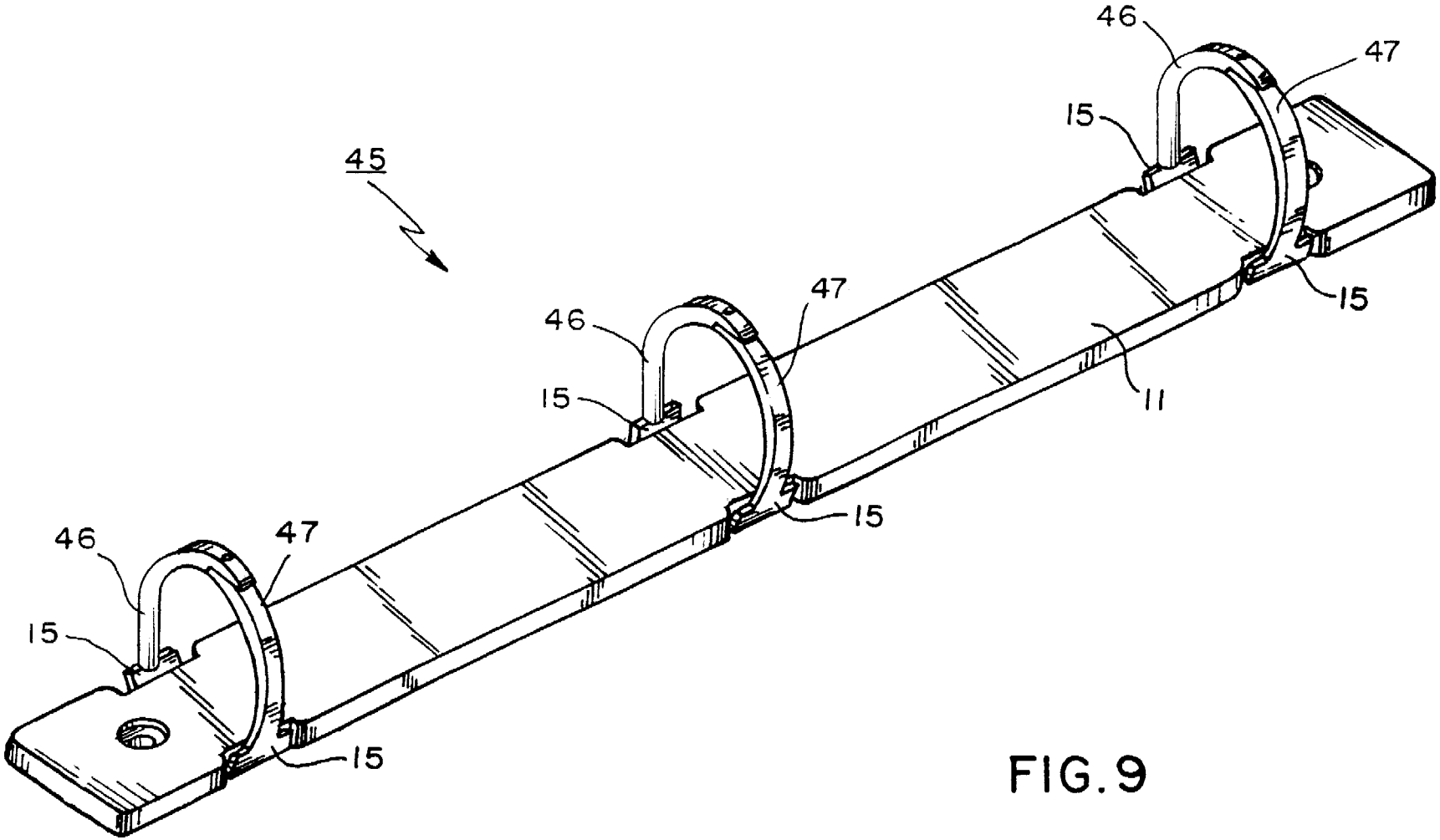
FIG. 9 is a perspective view of another emobodiment of a binder ring structure according to the invention.

The second embodiment 45 in FIG. 9 has paired curved arms 46, 47 which are configured to define a D configuration of the binder rings. The loose-leaf binder ring structure is otherwise similar to that of FIGS. 1 and 5.

What I claim is:

1. A molded plastic one-piece loose-leaf binder ring structure for binding loose perforated sheets and book pages and for use in binders and notebooks comprising:

an elongated base plastic strip made of a flexible molded plastic;

said base strip having integral longitudinal ribs rigidifying the strip;

said base strip having two opposite longitudinal side edges each having integral therewith plastic flexible lugs spaced longitudinally on the base strip and extending outwardly laterally therefrom;

said flexible lugs being paired on opposite side edges of the base strip;

a plurality of ring-forming paired curved arms each integral with a respective lug;

each curved arm having curvature along the length of the curved arm extending away from the corresponding lug and the base strip;

each curved arm having a cross section greater than a thickness of a corresponding flexible hinge lug;

each flexible lug defining a flexible hinge for a corresponding integral curved arm thereon for allowing the curved arms of each respective pair of the paired lugs to be manually biased toward each other after insertion thereof into holes of perforated sheets and positioning of free-end portions of the respective pair of arms of the paired arms in an overlying relationship and in position for manually pressing together the overlying free-end portions for engaging mutually cooperatively associated fastening means formed on said curved arms of a respective pair to be joined as extensions of each other defining a corresponding binder ring; and one curved arm of each pair of curved arms having a projection on a free-end portion thereof, and being depressable away from one part of said fastening means for opening the fastening means to allow manually biasing the curved arms away from each other for inserting and/or removing perforated sheets from said binder ring structure.

2. A molded plastic one-piece loose-leaf binder ring structure according to claim 1, in which said base strip has recesses on opposite sides thereof each in registry with a respective flexible lug, the recesses each being dimensioned to allow flexure of the corresponding flexible lugs toward the base strip for positioning of said curved arms defining a corresponding binder ring.

3. A molded plastic one-piece loose-leaf binder ring structure according to claim 1, in which the curved arms of a respective pair of arms have a different curvature from each other.

4. A molded plastic one-piece loose-leaf binder ring structure according to claim 1, in which the curved arms on a given side edge of the base strip have a same curvature and the curved arms on an opposite side edge of the base strip all have a same common curvature, but one which is different from the curvature of the curved arms on said given side edge of the base strip.

5. A molded plastic one-piece loose-leaf binder ring structure according to claim 1, in which the curved arms of a paired curved arm on a longitudinal side of said base strip have a different curvature from the curvature of the curved arms on the opposite longitudinal side of said base strip.

6. A molded plastic one-piece loose-leaf binder ring structure according to claim 5, in which all of the lugs on one side edge of the base strip are similarly shaped and all of the lugs on an opposite side edge of the base strip are similarly shaped, but said lugs on said opposite side edge of the base strip are shaped and dimensioned different from said lugs on said one side edge of the base strip.

7. A molded plastic one-piece loose-leaf binder ring structure according to claim 6, in which all of the curved arms on said one side edge of the base strip have a similar curvature and all of the curved arms on the opposite side edge of the base strip have a similar curvature, and the curved arms on said one side edge and said opposite side edge of the base strip have mutually cooperatively associated fastening means for coupling and uncoupling of said curved arms.

8. A molded plastic one-piece loose-leaf binder ring structure according to claim 1, in which said base strip comprises means for mounting the loose leaf binder ring structure in a binder or book or notebook.

9. A molded plastic one-piece loose-leaf binder ring structure according to claim 7, wherein said fastening means comprising a mating aperture and button head on each paired oppositely disposed ring-forming curved arms.

10. A molded plastic one-piece loose-leaf binder ring structure according to claim 1, wherein one curved arm of each pair of the paired curved arms having a tongue with a hole thereon on a free-end portion thereof and a second curved arm of each pair of the paired curved arms having a rigid projection received in a respective hole of said one curved arm for defining a respective snap lock for locking the respective curved arms of the individual pairs of curved arms in positions defining corresponding binder rings when the corresponding overlying end portions are pressed together for inserting a corresponding projection into a respective hole in which it is received.

* * * * *